United States Patent [19]

Higdon

[11] 4,297,922

[45] Nov. 3, 1981

[54] JAW SUPPORT FOR A POWER TONGS

[76] Inventor: Charles O. Higdon, 601 Howard Dr., Del City, Okla. 73115

[21] Appl. No.: 140,837

[22] Filed: Apr. 16, 1980

[51] Int. Cl.[3] ..... B25B 17/00

[52] U.S. Cl. ..... 81/57.18; 81/57.2

[58] Field of Search ..... 81/57.18, 57.2

[56] References Cited

U.S. PATENT DOCUMENTS

| | | | |
|---|---|---|---|
| 2,435,972 | 2/1948 | Lundeen | 81/177 R |
| 2,650,070 | 8/1953 | Lundeen | 81/57.18 |
| 2,703,221 | 3/1955 | Gardner | 81/57.18 |
| 2,989,880 | 6/1961 | Hesser et al. | 81/57.18 |
| 3,261,241 | 7/1966 | Catland | 81/57.18 |

*Primary Examiner*—James L. Jones, Jr.
*Attorney, Agent, or Firm*—Dunlap, Codding & McCarthy

[57] ABSTRACT

A jaw support for a power tongs having a rotatable rotor for turning a pipe via a jaw and anvil mounted on the rotor via the jaw support. The jaw support comprises two support plates which sandwich the rotor and support the jaw and anvil. The jaw is actuated by rollers disposed in the rotor and engaged by a portion of the jaw. Engagement between a portion of the jaw and portions of the jaw support limits pivotation of the jaw on the jaw support and the actuation of the jaw via rollers on the roller limits pivotation of the jaw with respect to the rotor so that relative rotation between the jaw support and the rotor is limited at such times that the jaw is mounted on the jaw support. The support plates are dimensioned to overlay holes in the rotor which support roller pins used to mount the rollers in the rotor at such times that the jaw support is within the limited range of relative rotation thereof on the rotor when the jaw is mounted on the jaw support so that the jaw support maintains the roller pins and rollers in the rotor during operation of the tongs. An opening is formed in the support plates and the jaw is removable from the jaw support to permit the opening to be aligned with the roller pins for replacement of rollers in the rotor.

6 Claims, 7 Drawing Figures

JAW SUPPORT FOR A POWER TONGS

BACKGROUND OF THE INVENTION

1. Field of the Invention

The present invention relates generally to improvements in power tools and, more particularly, but not by way of limitation, to power tongs used to turn pipes and the like to assemble and disassemble drill strings and the like in oil well drilling operations.

2. Brief Description of the Prior Art

In drilling an oil well, the drill string is lengthened as the depth of the well is increased by the addition of pipes to the upper end of the string. Removal of the string from the well similarly involves the disassembly of the string by removal of pipes from the upper end of the string. The pipes are provided with screw fittings so that the assembly and disassembly operations involve the turning of a pipe while the remainder of the drill string is held in a fixed position.

Because of the size of drill pipes, power tongs have been developed to facilitate the turning of such pipes and various types of tongs are known in the art. While these types of tongs vary in construction and use, they include certain basic components and their use imposes certain basic requirements on the capabilities of these components. In general, a power tongs will include a case which is suspended via a leveling mechanism so that the tongs can be aligned with the pipe prior to use. A rotor is mounted on the case along with a motor for driving the rotor and a jaw assembly is supported on the rotor for gripping the pipe so that the pipe can be turned via a rotation of the rotor. To accomplish this purpose, the jaw assembly is designed to first grip the pipe when the rotor is turned in the direction in which the pipe is to be turned and, then, to transmit the force of the motor to the pipe. To release the pipe, the rotor is turned in the opposite direction and the jaw assembly is constructed to release the pipe when the direction of rotation of the rotor is reversed.

The need for the power tongs to grip or release a pipe depending upon the direction in which the rotor is turned, along with the need to turn the pipe in one direction for assembly of a drill string and in an opposite direction for disassembly of the drill string, presents the basic problem of power tongs construction. At times, it is necessary that the jaws of the tongs grip the pipe in response to a clockwise direction of rotation of the rotor relative to the pipe and release the pipe in response to a counter clockwise rotation of the rotor. At other times, it is necessary for gripping to occur upon a counter clockwise rotation of the rotor and for release to occur upon clockwise rotation of the rotor. Various schemes have been employed to provide power tongs with selectivity in the direction of rotation of the rotor which is to cause a pipe to be gripped or released. Thus, the power tongs disclosed in U.S. Pat. No. 2,703,221 issued Mar. 1, 1955 to Gardner, utilizes inversion of the tongs to achieve such selectivity. That is, the tongs disclosed by Gardner is constructed such that the jaws will grip a pipe when the rotor is turned in one direction relative to the case of the tongs and will release the pipe when the rotor is turned in the opposite direction relative to such case. The orientation of the tongs relative to the pipe then determines whether the gripping direction will turn the pipe in a clockwise or counter clockwise direction relative to the drill string.

While the tongs inversion scheme disclosed by Gardner solves the problem of providing a power tongs with selectivity in the direction of rotation of the rotor, relative to the pipe, which will cause the pipe to be gripped, this scheme can give rise to another problem. As has been noted by Lundeen in U.S. Pat. No. 2,435,972 issued Feb. 17, 1948, it is important that a tongs be leveled prior to the gripping of a pipe thereby. It has been found that such a leveling after inversion can be a time consuming and, consequently, expensive chore.

A scheme for selecting the direction of rotation of the rotor which will cause the jaws to grip the pipe, and which does not suffer from problems involving repeated leveling of the tongs, it is used in a power tongs manufactured by B. J. Hughes, Inc. of Houston, Tex. In this tongs, a jaw and anvil are pivotally mounted on a jaw support which, in turn, is mounted on the rotor of the tongs. A frictional drag is applied to the jaw support so that the jaw support is held fixed during the initial rotation of the rotor. The jaw has a portion which projects into the rotor between two rollers disposed therein so that, when the rotor is turned in one direction, one of the rollers will engage the jaw to pivot the jaw toward the pipe which is disposed within central apertures of both the rotor and the jaw support. After the pipe has been engaged, continued rotation of the rotor turns the jaw support and the pipe. To release the pipe, the rotor is turned in the opposite direction to cause the other of the two rollers to engage the jaw and pivot the jaw away from the pipe. Selectivity in the direction of rotation of the rotor to cause the jaw to grip the pipe against the anvil is provided by mounting the jaw and anvil via pins so that the jaw and anvil can be interchanged on the jaw support and by providing the rotor with two pairs of rollers on opposite sides of the rotor. Both the jaw support and the rotor have a mirror symmetry so that the selection of the pair of rollers to be utilized to pivot the jaw determines the direction the jaw will be pivoted, toward or away from the pipe, when the rotor is turned in a given direction.

While tongs which utilize jaw and anvil interchangeability to achieve selectivity in the direction of rotation of the rotor to cause gripping of a pipe to be turned by the tongs eliminates the need for leveling the power tongs each time the direction in which a pipe is to be turned is reversed, such tongs introduce a new problem. The rollers used to actuate the jaw of such tongs are subjected to considerable battering in the operation of the tongs and, as a result, can become jammed in the rotor after a period of operation. This jamming causes the rollers to slide, rather than roll, on the jaw when the tongs is used to give rise to excessive wear of the jaw. Accordingly, when a roller becomes jammed, it is necessary that the roller be replaced if expensive subsequent repair of the tongs is to be avoided. In power tongs heretofore known, such replacement of the rollers has required that the tongs be disassembled to obtain access to the rollers.

SUMMARY OF THE INVENTION

The present invention exploits the manner in which a power tongs of the interchangeable jaw and anvil type operates to provide such a tongs with a rapid roller replacement capability. In tongs of this type, the actuation of the jaw by rollers which engage opposite sides of a portion of the jaw, limits pivotation of the jaw relative to the rotor. Similarly, pivotation of the jaw relative to the jaw support is limited by engagement of portions of the jaw with portions of the jaw support and by engagement of the jaw with the pipe the tongs turns. The limitation of pivotation of the jaw relative both to the rotor and to the jaw support thus limits the range of rotation of the jaw support on the rotor at such times that the jaw is mounted on the jaw support. However, at such times that the jaw is removed from the jaw support, the jaw support is decoupled from the rotor so that the jaw support can be oriented relative to the rotor at any angle throughout a 360° range.

The present invention contemplates that portions of the jaw support be used to retain the rollers within the rotor of the power tongs, at such times that the range of rotation of the jaw support is limited by the jaw, while providing a capability for removing each roller for an angle of orientation between the jaw support and the rotor outside such limited range. To this end, the rollers are mounted in the rotor via roller pins which extend through opposing end walls of the rotor so that a roller can be removed by sliding the pin upon which such roller is mounted axially from the rotor. In order to retain the pins in the rotor, the jaw support comprises two support plates which are disposed flush against the end walls of the rotor. The support plates include an arcuate portion having an extent sufficient to engage the ends of the roller pins throughout the limited range of rotation of the jaw support on the rotor resulting from the support of the jaw by the jaw support in a position wherein the rollers can be utilized to force the jaw against or away from a pipe extending through the rotor. Openings in the support plates, between the arcuate portions, are sized to permit removal of the roller pins at such times that the jaw support is rotated on the rotor to align the openings through the support plates with the roller pins. Thus, the rollers can be removed for replacement by removing the jaw from the jaw support to free the jaw support for relative rotation with the rotor and, subsequently, positioning the jaw support on the rotor to align the openings in the support plates with the roller pin supporting the roller to be replaced.

An object of the present invention is to provide an improved power tongs of the interchangeable jaw and anvil type.

Another object of the present invention is to provide a power tongs of the interchangeable jaw and anvil type with a rapid repair capability.

Yet a further object of the invention is to provide a power tongs which minimizes the time required for operation of the tongs and, concurrently, minimizing the time required to affectuate repairs upon such tongs.

Other objects, advantages and features of the present invention will become clear from the following detailed description of the preferred embodiment of the invention when read in conjunction with the drawings and appended claims.

DESCRIPTION OF THE PREFERRED EMBODIMENT

Figure 1:
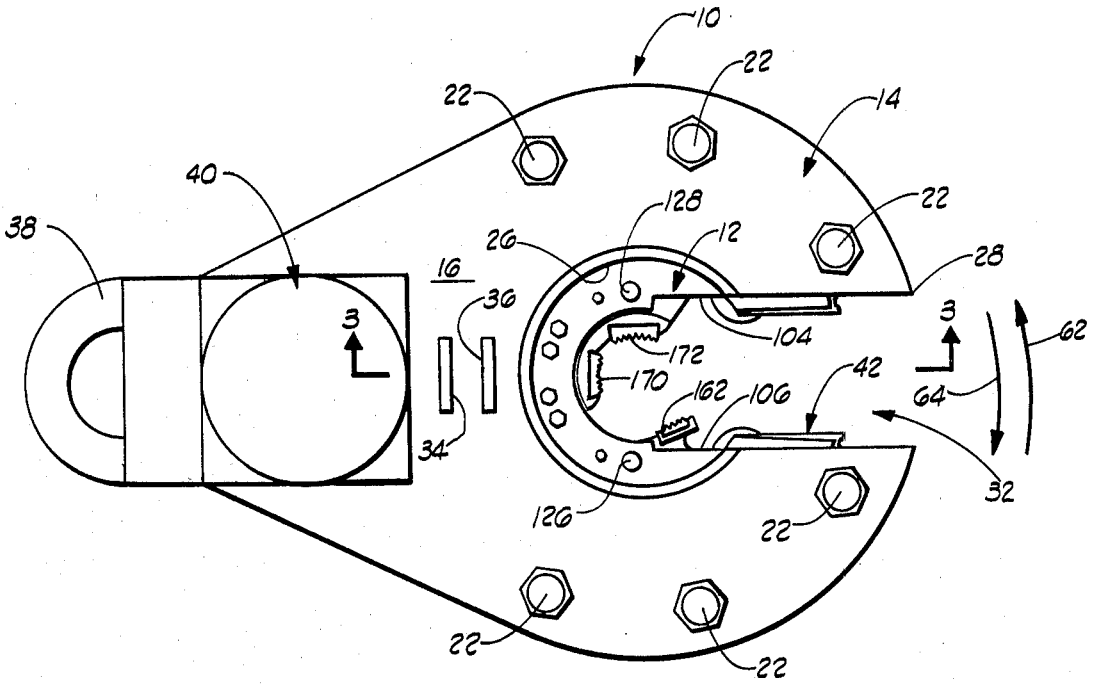
FIG. 1 is a plan view of a power tongs incorporating an improved jaw support constructed in accordance with the present invention.
Figure 2:
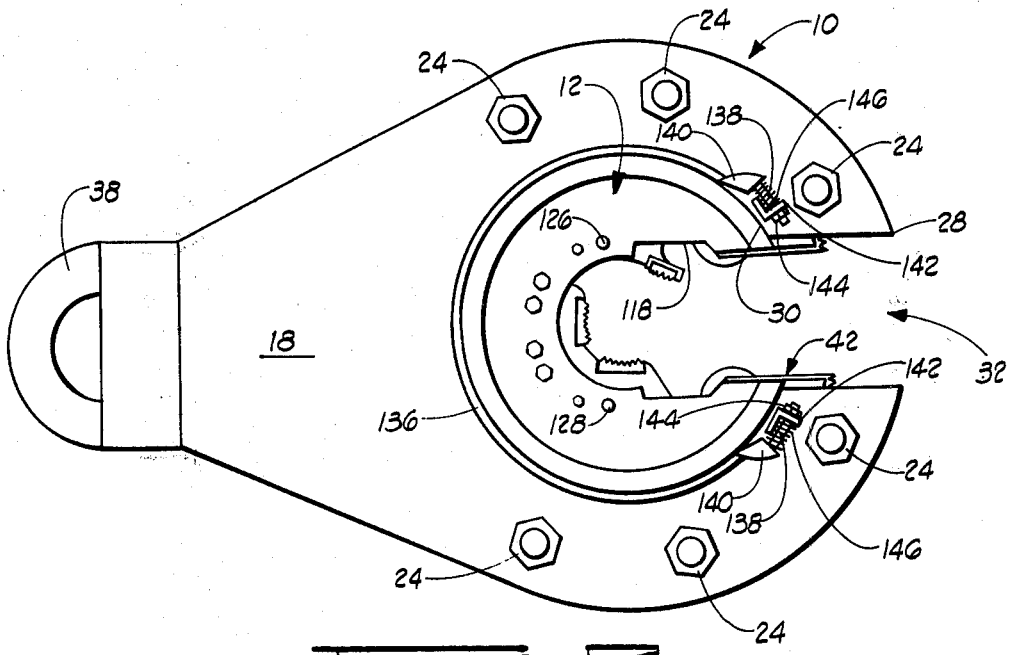
FIG. 2 is a bottom view of the power tongs of FIG. 1.
Figure 3:
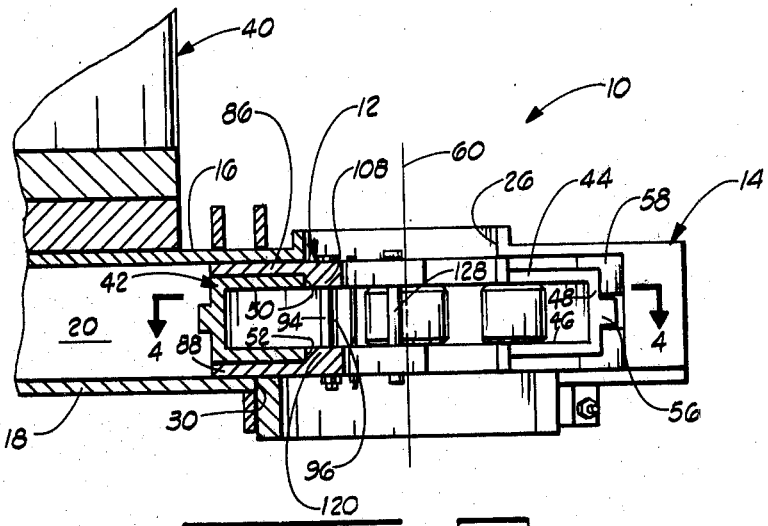
FIG. 3 is a cross section of the power tongs of FIG. 1 taken substantially along line 3—3 of FIG. 1.

Referring now to the drawings in general and to FIGS. 1, 2 and 3 in particular, shown therein and designated by the general reference numeral 10 as a power tongs having an improved jaw support 12 constructed in accordance with the present invention. The tongs 10 include a case 14 having: a top cover plate 16 (FIG. 1); a bottom cover plate 18 (FIG. 2), disposed substantially parallel to the top cover plate 16 and spaced a distance therefrom; and a peripheral wall 20 (FIG. 3) which is formed integrally with the top cover plate 16 and extends to the bottom cover plate 18. The bottom cover plate 18 is bolted to the top cover plate 16 via a plurality of bolts 22 (FIG. 1) which extend through suitable apertures (not shown) in the cover plates 16, 18 and accept nuts 24 (FIG. 2) to clamp the bottom cover plate 18 against the wall 20.

The case 14 has an elongated structure and a generally circular aperture 26 is formed through the top cover plate 16 near one end 28 thereof. A generally circular aperture 30, coaxial with the aperture 26, is formed through the bottom cover plate 18. Portions of the cover plates 16, 18 and the wall 20 between the apertures 26 and 30 and the end 28 of the case 14 are cut away to form a channel 32 extending from the end 28 into the interior of the case 14. By means of the channel 32, a pipe (not shown) or the like to be rotated by the tongs 10 can be positioned so as to extend through the tongs 10, in a substantially coaxial relation with the apertures 26 and 30, by moving the tongs 10 with respect to the pipe so as to introduce the pipe into the tongs 10 through the channel 32.

In the use of the tongs 10, the tongs 10 is suspended from a derrick via a leveling device (not shown) and lugs 34, 36 are welded to the top cover plate 16 for connecting the tongs 10 to the leveling device in a well-known manner. A bracket 38 is mounted on the case 14 opposite the end 28 to form a means for securing the tongs 10 against rotation during use of the tongs 10 to rotate a pipe or the like extending through the apertures 26 and 30. A reversible motor 40, preferably a hydraulic motor, is mounted on the top cover plate 16 for turning the pipe as will be discussed below.

Figure 4:
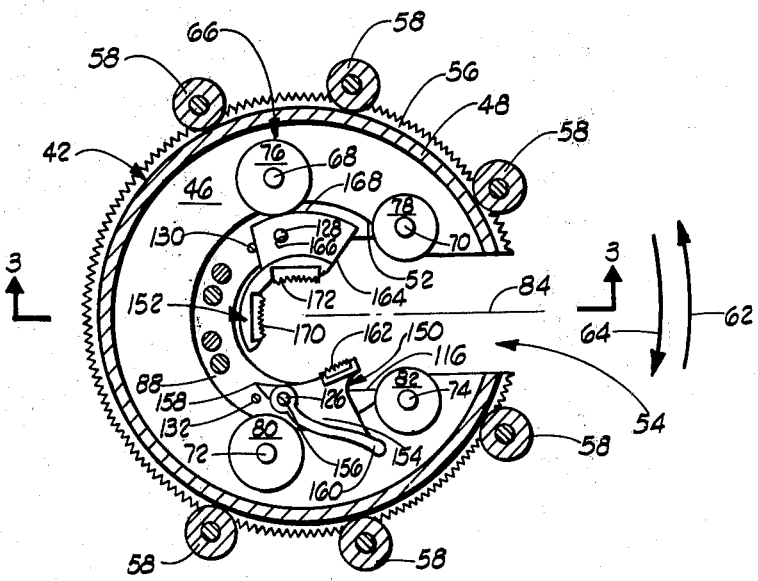
FIG. 4 is a cross section of the rotor of the power tongs taken substantially along line 4—4 of FIG. 3.

The tongs 10 further comprises a rotor 42 which is shown more particularly in FIGS. 3 and 4. The rotor 42 comprises a first end wall 44 (not shown in FIG. 4) and an opposed, parallel second end wall 46 spaced from the first end wall 44 by a generally circular peripheral wall 48 such that the rotor 42 has a generally circular, hollow, box-like structure. More particularly, the end walls 44, 46 have substantially equal diameter central apertures, 50 and 52 respectively, so that the rotor 42 is generally annular in form. Portions of the rotor 42 are cut away between the apertures 50, 52 and the periphery of the peripheral wall 48 to form a channel 54 (FIG. 4) from one side of the rotor 42 to the interior thereof in the same manner that the channel 32 is formed in the case 14.

A toothed ridge 56 is formed about the peripheral wall 48 of the rotor 42 and the rotor 42 is both mounted on the case 14 and driven by the motor 40 via the ridge 56. Specifically, for mounting the rotor 42, the bolts 22, by means of which the case 14 is assembled, extend along axes which are parallel to and equidistant from the common axes of the apertures 26 and 30 through the cover plates 16 and 18 respectively so that the bolts 22 are arranged in a circle about the apertures 26 and 30. Mounted on each of the bolts 22, within the case 14, is a rotor mounting roller 58 having end portions of a diameter sufficient to engage portions of the peripheral wall 48 of the rotor 42 at such times that the rotor 42 is disposed within the case 14 with the axis 60 thereof disposed along the common axes of the apertures 26 and 30 in the cover plates 16 and 18. A central portion (not shown) of each roller 58 is formed on a reduced diameter to form internal shoulders in the rollers 58 which engage the ridge 56 to mount the rotor 42 in the case 14. The rotor is turned via a suitable gear train connected between the motor 40 and the teeth on the ridge 56 as is known in the art. Since the motor 40 is reversible, the rotor 42 can be selectively turned in a first driven direction 62 and in a second driven direction 64 and such directions have been indicated by directional arrows in FIGS. 1 and 4.

The rotor 42 supports a jaw actuating assembly, generally designated 66 in FIG. 4, which is utilized to cause a pipe disposed along the axis 60 of the rotor 42 to be gripped by the tongs 10 when the rotor 42 is turned in a selected one of the first and second driven directions 62, 64 as will be discussed below. The jaw actuating assembly 66 comprises four roller pins 68–74 which extend axially through the rotor 42 and rotatably support four rollers 76–82 within the rotor 42 as has been indicated in FIG. 4. Suitable aligned pairs of rollers mounting holes, not shown, are formed through the end walls 44, 46 of the rotor 42 to permit insertion of the pins 68–74 through the rotor 42. The roller mounting holes are of a diameter to receive the pins 68–74 and are aligned axially with respect to the rotor 42 to maintain the axes of the rollers 76–82 parallel to the axis 60 of the rotor 42. The pins 68–74 are maintained in position in the rotor 42 by the jaw support 12 in a manner to be discussed below. The rollers 80 and 82 are positioned symmetrically to the rollers 76 and 78 respectively, about the channel 54 in the rotor 42, as has been indicated in FIG. 4. That is, the center of the channel 54 defines a selected radius 84 for the rotor 42 and the positions of the rollers 80 and 82 mirror the positions of the rollers 76 and 78 respectively with respect to the radius 84.

Figure 5:
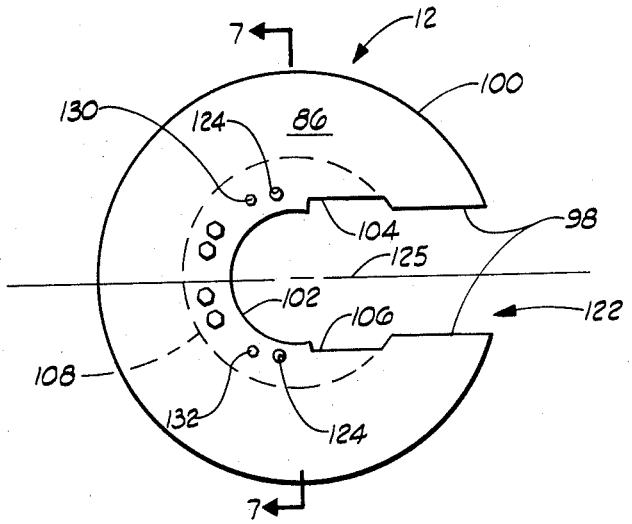
FIG. 5 is a plan view of the improved jaw support of the present invention.
Figure 6:
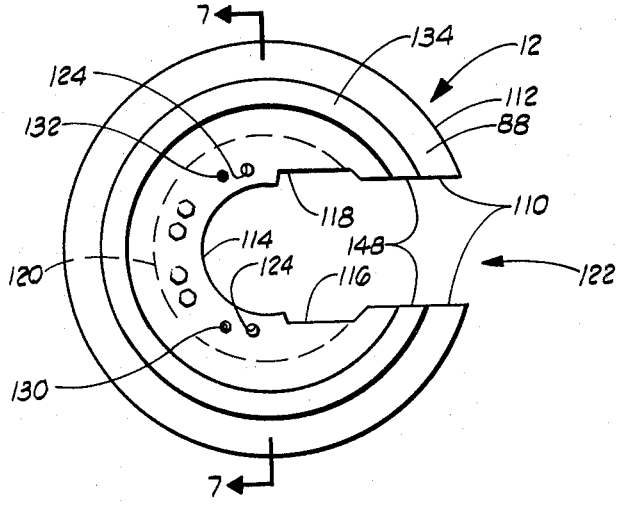
FIG. 6 is a bottom view of the jaw support shown in FIG. 5.
Figure 7:
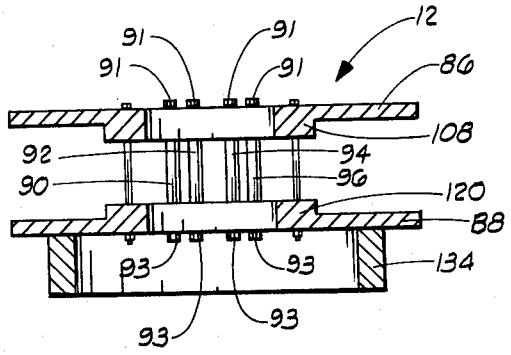
FIG. 7 is a cross section in side elevation of the improved jaw support taken substantially along line 7—7 of FIG. 5.

The jaw support 12, shown in FIGS. 5 through 7, generally comprises a first support plate 86 and a second support plate 88 which are connected together in a spaced apart, parallel relation by a plurality of spacers 90–96 bolted to the plates 86, 88 and extending therebetween.

As indicated in FIG. 7, the spacers 90–96 can have the form of cylindrical bars which receive bolts 91, passing through the plate 86, and bolts 93, passing through the plate 88, in threaded holes (not shown) formed in the ends of the spacers 90–96. (In a preferred embodiment, holes formed through the plates 86, 88 for the bolts 91, 93 are counterbored to receive portions of the spacers 90–96.) As is more particularly shown in FIG. 5, the first support plate 86 is generally circularly arcuate in form with a cut 98 formed between the outer periphery 100 thereof and the inner periphery 102 thereof opposite the spacers 90–96. Slots 104 and 106, symmetrically positioned with respect to a center line of the cut 98, are formed in opposite sides of the cut 98 for a purpose to be discussed below. A generally circularly arcuate projection 108 is formed concentrically with the peripheries 100, 102 on one side of the first support plate 86 as has been shown in dotted lines in FIG. 5 and in cross section in FIG. 7. The projection 108 has a diameter which is slightly smaller than the diameters of the apertures 50, 52 formed in the end walls 44, 46 of the rotor 42 and the diameter of the outer periphery 100 of the first support plate 86 is slightly smaller than the diameter of the peripheral wall 48 of the rotor 42. The purpose of making the diameters of the projection 108 and the first support plate 86 slightly smaller than the diameters of the apertures 50, 52 and the wall 48 respectively, will be discussed below. Thus, the first support plate 86 can be mounted on the rotor 42 with the first support plate 86 disposed flush against the first end wall 44 of the rotor 42 and with the circular projection 108 extending into the aperture 50 in the first end wall 44 of the rotor 42 as has been shown in FIG. 3. As is indicated by FIGS. 5 through 7, the second support plate 88 is identical to the first support plate 86. In particular, the second support plate 88 has a cut 110, identical to the cut 98, extending between the outer periphery 112 and the inner periphery 114 of the second support plate 88 and symmetrically spaced slots 116 and 118 are formed in the sides of the cut 110 in the same manner as the slots 104 and 106 are formed in the sides of the cut 98. Similarly, the second support plate 88 has a central generally circularly arcuate projection 120 identical to the projection 108.

In the assembled jaw support 12, the projections 108 and 120 are aligned in a coaxial, facing relation and the spacers 90–96 are positioned to extend between the projections 108 and 120. The lengths of the spacers 90–96 are selected so that the rotor 42 can be sandwiched between the support plates 86 and 88 of the jaw support 12 as has been indicated in FIG. 3. That is, the first support plate 86 is disposed flush against the first end wall 44 of the rotor 42 with the projection 108 extending into and engaging the aperture 50 formed through the first end wall 44 and the second support plate 88 is disposed flush against the second end wall 46 of the rotor 42 with the projection 120 extending into and engaging the aperture 52 formed through the second end wall 46. Moreover, the cuts 98 and 110 and the support plates 86 and 88 are aligned as has been indicated in FIGS. 5 and 6 so that the cuts 98 and 110 coact to form a channel 122 into a central aperture of the jaw support 12, formed by the inner peripheries 102 and 114 of the plates 86 and 88, in the same manner that the channel 54 is formed into the rotor 42. The center of the channel 122 defines a reference line, indicated at 125 in FIG. 5, on the jaw support 12 about which the jaw support 12 is bilaterally symmetric. That is, portions of either support plate 86, 88 to one side of the line 125 mirror portions of such plate 86, 88 to the other side of the line 125. As will be clear to those skilled in the art, the above recited construction of the support plates 86, 88 and the mounting of the plates 86, 88 on the rotor 42 as described disposes portions of the plates 86, 88 radially outward of the projections 108, 120 in an overlaying relation with respect to the end walls 44, 46 of the rotor 42 and such relation will extend through an angular range determined by the relative orientation of the jaw support 12 on the rotor 42 and by the widths of the cuts 98 and 110. This angular range will be discussed in more detail below.

Formed perpendicularly through each of the support plates 86, 88 are two jaw mounting holes 124 on opposite sides of the cuts 98 and 110 and positioned in mirror symmetry with respect to the reference line 123. Such positioning, and the assembly of the jaw support 12 as has been described above, forms the holes into two aligned pairs, one member of each pair being formed through the first support plate 86 and the other being formed through the second support plate 88. The pairs of holes accept jaw pins 126, 128 (FIGS. 1 and 2) and the diameters of the apertures 26 and 30 formed through the cover plates 16 and 18 of the case 14 are selected such that each of the pins 126, 128 can be inserted into a selected one of the aligned pairs of holes 124 at such times that the jaw support 12 is mounted on the rotor 42 within the case 14.

Referring once again to FIGS. 5 through 7, the jaw support 12 further comprises a pair of bolts 130, 132 which extend through suitably positioned holes (not shown) formed through the support plates 86, 88 such that bolts 130, 132 are symmetrically positioned on opposite sides of the reference line 123 and are displaced from the holes 124 generally away from the cuts 98, 110. The purpose of the bolts 130, 132 will be discussed below.

A broken ring 134 is welded to the side of the second support plate 88 opposite the side of the second support plate 88 facing the first support plate 86. The ring 134 extends normally to the second support plate 88 and has a diameter slightly smaller than the diameter of the aperture 30 formed through the bottom cover plate 18. The ring 134 is mounted coaxially with the outer periphery 112 of the second support plate 88 so that, when the jaw support 12 is mounted on the rotor 42, the axis of the ring 134 will lie substantially along the axis of the aperture 30. The axial width of the ring 134 is selected such that the ring 134 will extend through the aperture 30 for engagement with a brake strap 136, shown in FIG. 2, which extends about the outer periphery of the ring 134. As shown in FIG. 2, the brake strap 136 is secured to the bottom cover plate 18 via bolts 138 which extend through holes (not shown) in brackets 140 on the ends of the brake strap 136 and which further extend through tabs 142 welded to the bottom cover plate 18 on opposite sides of the channel 32. Nuts 144 are disposable on the bolts 138 to permit ready attachment and detachment of the brake strap 136. Springs 146 are disposed on the bolts 138 between the brackets 140 and the tabs 142 and the nuts 144 are adjusted on the ends of the bolts 138 such that the brake strap 136 exerts an adjustable frictional drag on the ring 136 tending to hold the jaw support 12 in a fixed position on the case 14 at such times that the rotor 42, engaged by the jaw support 12 as discussed above, is rotated by the motor 40. The break in the ring 134, designated 148 in FIG. 6, has a width equal to the width of the cut 110 formed in the second support plate 88 and is aligned therewith to avoid blocking the channel 122 formed into the jaw support 12.

It has been found through experimentation that it is desirable to use a relatively wide brake strap 136 and adjust the nuts 144 to provide a relatively small frictional drag on broken ring 134 by the brake strap 136. As will be discussed below, the brake strap 135 holds the jaw support 12 fixed relative to the case 14 while the rotor 42 is rotated through a small angle at the initiation of a pipe turning operation. Thereafter, the jaw support 12 is turned against the frictional drag exerted on ring 134 by strap 136. A wider strap 136 extends the lifetime of portions of the strap 136 that engage the broken ring 134. It has been found that a suitable width for the strap 136 engaging a thirteen and one-quarter inch diameter ring 134 is one and one-half inches.

The tongs 10 further comprises a detachable jaw 150 and anvil 152 which can be mounted on the jaw support, as shown in FIG. 4, via the pins 126, 128 extending through the aligned pairs of holes 124 formed through the support plates 86 and 88. The jaw 150 has a body portion 154 having a hole 156 formed therethrough near one end 158 thereof. The body portion 154 of the jaw 150 has a thickness, parallel to the axis of the hole 156, sufficiently small to permit portions of the body portion 154 to be inserted between the end walls 44, 46 of the rotor 42 and a roller engagement portion 160 of the body portion 154 of the jaw 150 is shaped to extend between the rollers 80 and 82 at such times that the channel 122 of the jaw support 12 is aligned with the channel 54 of the rotor 42 and the jaw 150 is mounted on the jaw support 12 via the pin 126 and the pair of aligned holes 124 in the support plates 86, 88 disposed on the same side of the aligned channels 54 and 122 that the rollers 80 and 82 are disposed. The jaw 150 is bilaterally symmetric with respect to a plane perpendicular to the axis of the hole 156 therethrough so that the jaw 150 can similarly be mounted on the jaw support 12 in mirror symmetry to the position of the jaw 150 shown in FIG. 4 so that the roller engagement portion 160 of the jaw 150 will extend, in such mirror position, between the rollers 76 and 78. For purposes of gripping a pipe, a grip 162 is formed on portions of the jaw 150 within the channel 122 of the jaw support 12 and such grip is oriented to face the axis 60 of the rotor 42 at such times that the jaw 150 is mounted on the jaw support 12. The grip 162 is elongated parallel to the hole 156 and has a length substantially equal to the axial width of the jaw support 12.

It will be noted that the mounting of the jaw 150 on the jaw support 12 via one of the pins 126, 128 on one side of the channel 122 in the jaw support 12 permits the jaw 150 to pivot on the jaw support 12 to move the grip 162 toward or away from a pipe disposed along the axis 60 of the rotor 42. Pivotation away from the pipe is limited by portions of the support plates 86, 88 wherein are formed the slots 104, 106 and 116, 118 as has been indicated for portions forming the slots 106 and 118 in the first and second support plates 86, 88 respectively in FIGS. 1 and 2. The slots 104, 106 and 116, 118 are formed in the plates 86, 88 to provide the jaw 150 with a suitable range of pivotation away from the axis 60 of the rotor 42 to permit ready access of a pipe or the like to the center of the rotor 42. As has been shown in FIG. 4, the bolts 130 and 132 extend through portions of the support plates 86, 88 to permit engagement of the bolts 130, 132 by portions of the jaw 150 between the hole 156 and the end 158 of the jaw 150 when the jaw 150 is pivoted to move the grip 162 toward the pipe axis 60 of the rotor 42. The bolt 132 prevents the jaw 150 from pivoting about pin 126, when the rotor 42 is rotated in the first driven direction 62, an amount sufficient to permit the roller engagement portion 160 of the jaw 150 to move from between the rollers 80 and 82. The bolt 130 similarly prevents the roller engagement portion 160 from moving from between rollers 76 and 78 when the jaw 150 and anvil 152 are interchanged, relative to the positions shown in FIG. 4, and the rotor 42 is turned in the second driven direction 64.

The anvil 152 has a flange portion 164 which has a hole 166 formed therethrough so that the anvil 152 can be mounted on the jaw support 12 in the same manner that the jaw 150 is mounted on the jaw support 12. That is, for operation of the tongs 10, the jaw 150 is mounted on the jaw support 12 via one pair of aligned holes 124 in the plates 86, 88 on one side of the channel 122 of the jaw support 12 and the anvil 152 is mounted via the pair of aligned holes 124 on the opposite side of the channel 122. The flange 164 has an arcuate periphery 168 which engages one of the pairs of rollers, 76 and 78 or 80 and 82, to fix the position of the anvil 152 on the jaw support 12. A portion of the anvil 152 extends into the center of the jaw support 12 and, more particularly, is formed in an arc about the axis of the rotor 42. Grips 170, 172 are formed on such portion of the anvil to face the axis 60 of the rotor 42 and the grip 162 on the jaw 150. As in the case of the jaw 150, the anvil 152 is bilaterally symmetric about a plane perpendicular to the hole 166 so that the anvil 152 can be mounted across the channel 122 of the jaw support 12 in mirror symmetry to the position of the anvil 152 shown in FIG. 4. Thus, the jaw 150 and anvil 152 can be positioned as shown in FIG. 4 or the jaw and anvil can be disposed in mirror symmetry to the positions shown in FIG. 4 by removing the pins 126, 128, inverting the jaw 150 and the anvil 152, and remounting the jaw 150 and anvil 152 such that the positions of the jaw and anvil are interchanged relative to the jaw support 12.

OPERATION OF THE PREFERRED EMBODIMENT

To use the power tongs 10 to turn a pipe or the like in the first driven direction 62, the jaw 150 and anvil 152 are mounted on the jaw support 12 as has been shown in the drawings and the channels 54 and 122 in the rotor 42 and jaw support 12 respectively are aligned with the channel 32 in the case 14 as has been particularly shown in FIGS. 1 and 2. The tongs 10 can then be moved relative to a pipe to move the pipe through the aligned channels 32, 54 and 122 to abut the grips 170, 172 in the anvil 152. The motor 40 is then operated to rotate the rotor 42 in the first driven direction 62. During the initial period of such rotation, the jaw assembly 12 will be held fixed against rotation by the brake strap 136 so that a relative rotation of the rotor 42 and the jaw support 12 will occur. As can be seen from FIG. 4, such relative rotation between the rotor 42 and the jaw support 12 will cause the roller 80 to engage the roller engagement portion 160 of the jaw 150 and pivot the jaw 150 to move the grip 162 toward the pipe. When the grip 162 engages the pipe, further pivotation of the jaw 150 about the pin 126 by means of which the jaw 150 is mounted on the jaw support 12 is disabled by clamping of the pipe between the jaw 150 and the anvil 152 so that the force of the roller 80 bearing against the jaw 150 rotates the jaw support 12 and the jaw 150 and anvil 152 to rotate the pipe extending through the tongs 10.

Once the purpose for rotating the pipe has been accomplished, the pipe can be released by rotating the rotor 42 in the second driven direction 64. In particular, when such rotation is commenced, the brake strap 136 will again initially hold the jaw support 12 in a fixed position on the case 14 so that a relative rotation between the rotor 42 and the jaw support 12 will occur. Such relative rotation moves the roller 82 against the roller engagement portion 160 of the jaw 150 to move the grip 160 on the jaw 150 out of engagement with the pipe. As rotation of the rotor 42 continues, the grip 162 will engage the portions of the support plate 86, 88 wherein the slots 106 and 118 are formed to prevent further pivotation of the jaw 150 on the jaw support 12 and discontinue relative rotation between the rotor 42 and the jaw support 12. The rotor 42 and jaw support 12 are thereafter rotated as a unit until the channel 122 in the jaw support 12 is again aligned with the channel 32 in the case 14. As will be clear from FIG. 4, the initial rotation of the rotor 42 to release the pipe can move the rotor 42 a short distance in the second driven direction 64 about the jaw support 12 so that the channel 54 in the rotor 42 will be displaced a short distance in the second driven direction 64 from the channels 32 and 122 in the case 14 and jaw support 12 respectively. If necessary to remove the pipe, the rotor 42 can be again rotated in the first driven direction 62 to bring the channel 54 into alignment with the channels 32 and 122. The tongs 10 can then be removed from the pipe by moving the tongs 10 such that the pipe exits through the aligned channels 32, 54 and 122. Should it be desired to rotate a pipe in the second driven direction 64, jaw pins 126 and 128 which hold the jaw 150 and anvil 152 on the jaw support 12 are removed, through the aperture 26 in the top cover plate 16 of the case 14, the jaw 150 and anvil 152 are interchanged on the jaw support 12 and the pins 126, 128 are reinserted through the holes 124 in the jaw support 12 and the holes 156 and 166 in the jaw 150 in the anvil 152 respectively so as to secure the jaw 150 and anvil 152 on the jaw support 12 in a mirror relation to the mounting of the jaw 150 and anvil 152 shown in FIG. 4. The tongs 10 is then operated in the same manner as described above differing only in that the directions of rotation of the rotor 42 and the jaw support 12 are reversed from the directions given above.

As will be clear from the above description of the construction and operation of the tongs 10, the jaw support 12 is disposed on the rotor 42 so that the support plates 86 and 88 will have a limited range of relative orientations with respect to the rotor 42 at such times that the jaw 150 is mounted on either side of the channel 122 formed through the jaw support 12. In the present invention, this limitation on the range of orientations of the support plates 86, 88 on the rotor 42 is utilized to provide the power tongs 10 with a rapid repair capability should the rollers 76–82 of the jaw actuating assembly become worn or damaged through the continual use of such rollers to position the jaw 150 for gripping a pipe to be turned by the tongs 10. In particular, the relative range of orientation of the jaw support 12 on the rotor 42 can, in part, be selected via the selection of the depths of the slots 104, 106, 116 and 118 formed in the support plates 86 and 88. Similarly, the bolts 130, 132 will limit the relative rotation of the jaw 150 on the jaw support 12 to limit the relative rotation of the jaw support 12 with respect to the rotor 42. These bolts 130, 132 are optional positive stops which are provided in the preferred embodiment but, as will be recognized by those skilled in the art, rotation of the jaw 150 toward the anvil 152 can be limited by inserting a length of pipe through the tongs 10 at any time that the rotor 42 is turned in a direction to move the grip 162 on the jaw 150 toward the grips 170, 172 of the anvil 152. Thus, regardless of whether the bolts 130, 132 are provided, the jaw support 12 can be caused to have only a limited and measurable range of relative rotation on the rotor 42. As has been noted above, the portions of the plates 86, 88 of the jaw support extend through an angular range determined by the widths of the cuts 98 and 110 formed therein. This angular range is selected such that, regardless of the relative orientation of the jaw support 12 on the rotor 42 within such range, the portions of the plates 86 and 88 engaging the end walls 44 and 46 of the rotor 42 will at all times overlay the pins 68–74 which support the rollers 76–82 within the rotor 42. Thus, at such times that the jaw 150 is mounted on the jaw support 12, the support plates 86 and 88 will overlay the end walls 44 and 46 of the rotor 42 to maintain the jaw actuating assembly 66 within the rotor 42. To replace any one of the rollers 76 through 82, the jaw 150 is mounted on the jaw support 12 as shown in FIG. 4 or in a mirror relation to the position of the jaw 150 shown in FIG. 4 and the rotor is turned to align the channel 122 of the jaw support 12 with the channel 32 in the case 14. The jaw 150 is then removed so that the rotor 42 can be turned throughout a full 360° range without causing a rotation of the jaw support 12. With the jaw removed, the rotor is turned to bring the roller to be replaced within the channel 32 of the case 14 so that the ends of the pin holding such roller are no longer overlaid by the support plates 86 and 88 of the jaw support 12. With such roller in such position, the pin holding such roller within the rotor 42 can be removed and the roller can be withdrawn from the rotor 42 into the central aperture formed therethrough by the apertures 50 and 52 in the end walls 44 and 46 of the rotor 42 respectively. A new rotor and/or pin can then be substituted and the rotor can be turned until the channel 54 thereof aligns with the channel 122 in the jaw support so that the jaw 150 can again be mounted on the jaw support 12. The mounting of the jaw 150 on the jaw support 12 thereafter prevents relative rotation between the jaw support 12 and the rotor 42 sufficient to permit dislodgment of the pins 68 through 74 and the power tongs 10 can thereafter be used in the manner described above.

As has been previously noted the diameters at the plates 86 and 88 of the jaw support 12 has been made slightly smaller than the outside diameter of the peripheral wall 48 of the rotor 42 and the diameters of the projections 108 and 120 on the plates 86 and 88 has similarly been made smaller than the diameters of the apertures 50 and 52 through the end walls 44 and 46 of the rotor 42. It has been found that the transmission of rotating forces from the rotor 42 to a pipe extending along the axis 60 via the jaw 150 and anvil 152, which are mounted on the jaw support 12, has a tendency to spread the channel 122 extending from the exterior of the jaw support 12 to the central aperture thereof. Such spreading can result in the projections 108 and 128 binding against the apertures 50 and 52, respectively, formed through the end plates 44 and 46, respectively, at the rotor 42. More importantly, such spreading can result in the outer peripheries 100 and 112 of the plates 86 and 88, respectively, engaging the rotor mounting rollers 58 during operation of the tongs 10. It has been found that engagement between the plates 86 and 88 and the rollers 58 causes a bead to build up on the peripheries 100 and 112 of the plates 86 and 88 and that such bead will eventually bind the jaw support 12 to the rotor 42 necessitating disassembly of the tongs 10 for repair. That is, the effect of spreading of the channel 122 is to substantially reduce the lifetime of the tongs 10 in the field between dismantling and overhaul of the tongs 10. Such reduced field lifetime is undesirable both because of the expense of repair of the tongs 10 and, more importantly, the lack of availability of the tongs 10 during repair. Specifically, it is highly undesirable for the tongs 10 to become inoperable during a drilling operation because of the expense of maintaining a drilling crew and drilling rig at a drilling site.

It has been found that a proper choice of materials and heat treatment of the material of which the plates 86 and 88 are formed, coupled with a suitable reduction in the diameters of the plates 86 and 88, with respect to the rotor 42, and in the diameters of the projections 108 and 128, with respect to the apertures 50 and 52, substantially eliminates problems associated with spreading of the channel 122, thereby enabling the tongs 10 to be provided with the abovedescribed advantages arising from the structure of the jaw support 12 herein described. By way of example, in one preferred embodiment of the present invention for use with a sixteen inch diameter rotor 42 having a nine inch diameter central aperture, the diameters of the plates 86 and 88 and of the projections 108 and 128 thereon are each made thirty thousands of an inch smaller than the diameters of the rotor 42 and the central aperture thereof respectively. In such preferred embodiment, the plates 86 and 88 are formed of AISI 4140 steel plate which is heat treated to a hardness of 35 to 40 Rockwell C. The plates 86 and 88 are three quarters of an inch thick through the projections 108 and 128 and portions of the plates 86 and 88 radially outward of the projections 108 and 128 are three eighths of an inch thick. In this one preferred embodiment, the diameters of the projections 108 and 128 are approximately nine inches and the diameters of the inner peripheries 102 and 114 are each approximately five and one quarter inches. The channel 122 in such preferred embodiment is similarly approximately five and one quarter inches wide.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. In a power tongs of the type having a rotatable rotor mounted on a case for rotation in first and second driven directions, said rotor having a central aperture for receiving a pipe to be turned and said rotor supporting a detachable jaw via a jaw support rotatably mounted on the rotor, and said power tongs including an actuating assembly for positioning the jaw to alternatively grip and release the pipe in response to a limited relative rotation between the rotor and the jaw support, wherein the rotor is characterized as having opposed end walls having a plurality of roller mounting holes formed therethrough, each of the roller mounting holes in one end wall of the rotor aligned with a roller mounting hole in the other end wall, and wherein the actuating assembly comprises a plurality of rollers each supported within the rotor via a roller pin inserted through a pair of aligned holes formed in opposite end walls of the rotor and extending therebetween, the improvement wherein the jaw support comprises:

a first support plate mounted flush against one of the end walls of the rotor;

a second support plate mounted flush against the other end wall of the rotor; and means connecting the first support plate to the second support plate; and wherein each of the support plates is characterized as having a generally arcuate form of an extent sufficient to overlay the roller mounting holes within the limited range of rotation of the jaw support on the rotor utilized for positioning the jaw to alternatively grip and release the pipe.

2. The power tongs of claim 1 wherein the actuating assembly is characterized as comprising two rollers disposed to one side of a selected radius on the rotor and two rollers symmetrically disposed on the opposite side of said selected radius of the rotor; wherein each of the support plates is characterized as having formed therethrough two jaw mounting holes disposed symmetrically about a preselected reference line on the jaw support, the jaw mounting holes in the first support plate aligning with the jaw mounting holes in the second support plate; wherein the jaw is characterized as having a hole formed through a portion thereof dimensioned to fit between the support plates; wherein the power tongs is further characterized as comprising a jaw pin insertable through the hole in the jaw and one pair of aligned holes formed in the support plates, whereby the jaw can be mounted on the jaw support to either side of said reference line; wherein the jaw is characterized as having a roller engagement portion extending between two of said rollers at such times that the jaw is mounted on the jaw support via one pair of aligned holes formed through the support plates and at such times that the reference line of the jaw support is aligned with said selected radius of the rotor; and wherein the jaw is characterized as being bilaterally symmetric about a plane perpendicular to the hole formed therethrough whereby the roller engagement portion of the jaw can be positioned between the other pair of rollers of the actuating assembly at such times that the jaw is mounted on the jaw support via the other pair of aligned holes formed through the support plates and at such times that the reference line of the jaw support is aligned with said selected radius of the rotor.

3. The power tongs of claim 2 wherein the rotor is characterized as having a channel extending from the central aperture formed therethrough to the outer periphery of the rotor, said channel extending symmetrically about said selected radius of the rotor, for insertion of an object to be rotated by the power tongs laterally into the circular aperture in the rotor; and wherein the generally arcuate form of each support plate is formed via a cut between inner and outer peripheries of the support plate, said cuts formed symmetrically about said reference line.

4. The power tongs of claim 1 wherein each of the support plates has a generally circularly arcuate projection formed on the side thereof positioned against the rotor, said projection extending into the central aperture formed in the rotor to mount the jaw support on the rotor for relative rotation therebetween.

5. The power tongs of claim 1, 2, 3 or 4 wherein an axially extending broken ring is mounted on the second support plate so as to extend coaxially with the axis of the rotor exteriorly of the case wherein the rotor is mounted and wherein the power tongs further comprises a brake strap mounted on the case thereof to extend about and engage the periphery of said broken ring.

6. The power tongs of claims 1, 2, 3 or 4 wherein the means connecting the first support plate to the second support plate comprises a plurality of spacers, each spacer bolted at one end thereof to one of the support plates and bolted at the other end thereof to the other of the support plates.

* * * * *